United States Patent [19]

Tsubai et al.

[11] Patent Number: 4,643,962

[45] Date of Patent: Feb. 17, 1987

[54] DYING ETCHED-BLEACHED SILVER IMAGES USING DYE SOLUTIONS WITH GLYCOL ETHER

[75] Inventors: Yasuo Tsubai; Koji Okazaki; Akio Yoshida, all of Nagaokakyo, Japan

[73] Assignee: Mitsubishi Paper Mills, Ltd., Tokyo, Japan

[21] Appl. No.: 789,953

[22] Filed: Oct. 21, 1985

[30] Foreign Application Priority Data

| | | | |
|---|---|---|---|
| Oct. 25, 1984 | [JP] | Japan | 59-225273 |
| Dec. 25, 1984 | [JP] | Japan | 59-277242 |
| Mar. 13, 1985 | [JP] | Japan | 60-49640 |
| May 13, 1985 | [JP] | Japan | 60-102404 |
| May 13, 1985 | [JP] | Japan | 60-102405 |
| Aug. 6, 1985 | [JP] | Japan | 60-173753 |
| Aug. 12, 1985 | [JP] | Japan | 60-178362 |
| Aug. 26, 1985 | [JP] | Japan | 60-188214 |

[51] Int. Cl.[4] ..... G03C 5/54; G03C 5/44; B41M 5/00

[52] U.S. Cl. ..... 430/205; 430/199; 430/248; 430/293; 430/326; 101/464

[58] Field of Search ..... 430/205, 248, 293, 326, 430/199; 101/464

[56] References Cited

U.S. PATENT DOCUMENTS

| | | | |
|---|---|---|---|
| 3,877,938 | 4/1975 | Shinozaki et al. | 430/205 |
| 4,038,077 | 7/1977 | Land | 430/205 |
| 4,203,765 | 5/1980 | Claeys et al. | 430/205 |

*Primary Examiner*—Richard L. Schilling

*Attorney, Agent, or Firm*—Cushman, Darby & Cushman

[57] ABSTRACT

Disclosed is a process for forming a colored photographic image, wherein a photographic material bearing a silver image is subjected to an etching-bleach treatment and the unbleached areas are colored with a coloring solution to form a colored image, which comprises before or/and after said etching-bleach treatment coloring said photographic material with a coloring solution containing at least a water-soluble dye and a glycol ether. Thus obtained colored image may be further transferred to another substrate material.

16 Claims, No Drawings

DYING ETCHED-BLEACHED SILVER IMAGES USING DYE SOLUTIONS WITH GLYCOL ETHER

BACKGROUND OF THE INVENTION

This invention relates to a process of forming colored photographic images.

It is well known to etching-bleach the silver images. The silver complex diffusion transfer process (DTR process) and various applications of the process are also well known. The DTR process capable of forming silver images of high contrast, high resolution, and high density is applicable to the reproduction of documents, preparation of block copies, and the like. As one of known applications, there is described in Journal of Applied Photographic Engineering, Vol. 5, No. 3, pp. 171–172 (1979) a process for forming a colored image, wherein use is made of an image receptive material comprising a transparent film support and, provided thereon, an image receptive layer containing a pigment such as, for example, yellow, magenta, cyan, blue, red, or green one, and after the diffusion transfer development the silver image areas are etching-bleached, leaving behind colored image areas. The colored image thus obtained can be used in a poster, catalog, original for overhead projection, and overlay. Such a photographic material has already been on the market.

The disadvantage of the above process on the part of suppliers is the requirement of supplying the photographic materials in a large variety of colors; such a requirement cannot be met beyond a certain limit. The disadvantages on the part of consumers include the necessary stock of photographic materials in various colors; difficulty of selecting a desired color; uneconomical use of a plurarity of image receptive materials in combining pictures or letters of different colors; and impossibility of freely change the depth of color. Moreover, the colored image is not transferable to another image receptive sheet, because it is composed of a pigment. The transfer of colored image is very useful in combining or superposing different images to form various color images or in forming an image composed of developed silver and a color. The above disadvantages exist not only in the image receptive materials but also generally in common silver halide photosensitive materials.

The above-mentioned difficulties of the conventional process can be overcome by treating the silver image forming layer with a solution of a colorant capable of dyeing said layer at any stage such as, for example, after formation of silver image and before or after etching-bleach of the silver image. However, because it is a dye which colors the layer instead of a pigment in the conventional process, this method has several disadvantages such that owing to an insufficient affinity of the dye for gelatin, it is difficult to attain a sufficiently high color density and a sufficient dyeing speed even when a highly concentrated dye solution is used; when dyeing is carried out with different dyes, each dye diffuses to adjacent image areas, resulting in mixed color. Moreover, when a colored dye image is transferred to a substrate material, a dye staining tends to occur in the areas where the image transfer is not intended. Since the transfer is performed through the liquid medium, such staining seems to originate from the dye dissolved and diffused out of the colored image and from the dye dissolved and diffused out of the dye image which has been transferred to the substrate, both stainings occurring simultaneously under certain conditions of transfer. Another problem is the low density of transferred image, which can be increased to a certain extent by prolonging the time of transfer, which, however, accompanies an increase in staining.

SUMMARY OF THE INVENTION

An object of this invention is to provide a process for forming a colored photographic image, which is capable of rapidly producing a uniform dye image of sufficiently high color density even by using a dye solution of low concentration.

Another object of this invention is to provide a process for forming a colored photographic image, which comprises rapidly transferring the said colored dye image to a substrate material to form thereon a faithfully transferred dye image of high optical density.

A further object of this invention is to provide a dye and a photographic material which are suitable for forming the said colored photographic image.

DESCRIPTION OF THE INVENTION

It has now been found that the objects of this invention can be achieved by a process for forming a colored photographic image, wherein a photographic material bearing a silver image is subjected to an etching-bleach treatment and the unbleached areas are colored with a coloring solution to form a colored image, which comprises before or/and after said etching-bleach treatment coloring said photographic material with a coloring solution containing at least a water-soluble dye and a glycol ether. The coloring solution preferably contains a fluorinated surface active agent and a metal-chelating agent in addition to the glycol ether. The invention is described in detail hereunder.

The colorant used according to this invention is a water-soluble dye having a dyeing affinity for gelatin. Preferable dyes are direct dyes, acid dyes, acid mordant dyes, and reactive dyes described, for example, in "Handbook of Dyestuffs" (Institute of Organic Synthetic Chemistry, Editor, published July 20, 1970). Especially preferred are azo dyes such as monoazo and disazo dyes, and phthalocyanine dyes of the family of acid dyes. Metal complex dyes also produce good results. Most of the water-soluble dyes have a sulfo group.

Examples of the water-soluble dyes used in this invention are shown in the following table in Color Index (C. I.) General Names.

| | Yellow | Orange | Red | Green | Blue | Brown | Black |
|---|---|---|---|---|---|---|---|
| C.I. Direct | 28, 39, 50 | 6, 10, 26, 49 | 1, 2, 20, 23, 28, 62, 80, 83 | 1, 8 | 1, 15, 41, 71, 76, 78, 86, 98, 226 | 1A, 44, 95, 112 | 17, 19, 38, 51, 56, 75 |
| C.I. Acid | 7, 19, 23, 29, 42, 59, | 8, 10, 19, 28, 51, 74, | 1, 6, 18, 32, 85, 129, | 9, 12, 19, 28, 35 | 7, 23, 29, 74, 92, 117, | 2, 13, 28 | 1, 24, 52, 107 |

-continued

| | Yellow | Orange | Red | Green | Blue | Brown | Black |
|---|---|---|---|---|---|---|---|
| | 98, 99, 116, 141 | 87, 95 | 180, 186, 215, 249, 274 | | 127, 158, 170, 192, 234, 338 | | |
| C.I. Mordant | 3, 26 | 4, 29 | 9, 15, 19, 89 | | 13, 44, 76 | 1, 33 | 1, 3, 11 |
| C.I. Reactive | 2, 6, 12, 17 | 1, 2, 7 | 6, 7, 23 | 5, 6, 8 | 3, 9, 14, 15, 18, 20, 21, 26, 33, 38, 40 | 1, 8, 10 | 1, 5 |

The concentration of dye solution can be freely selected but is generally in the range of from about 1 to about 10%. It was found that if a dye solution containing no glycol ether is used, with the increase in dye concentration, the colored image is increased only slowly in depth of color, whereas when a dye solution containing glycol ether is used, the depth of color of the colored image is increased very rapidly with the increase in concentration of dye solution and a colored image of a high density is obtained with a dye solution of low concentration.

As the glycol ethers useful in the process of this invention, mention may be made of ethylene glycol monomethyl ether, diethylene glycol monomethyl ether, triethylene glycol monomethyl ether, polyethylene glycol monomethyl ether, propylene glycol monomethyl ether, dipropylene glycol monomethyl ether, ethylene glycol monoethyl ether, 3-methyl-3-methoxybutanol, ethylene glycol monopropyl ether, diethylene glycol monopropyl ether, propylene glycol monopropyl ether, ethylene glycol monoisopropyl ether, diethylene glycol monoisopropyl ether, ethylene glycol dimethyl ether, diethylene glycol dimethyl ether, diethylene glycol diethyl ether, ethylene glycol monoallyl ether, ethylene glycol monobutyl ether, diethylene glycol monobutyl ether, and triethylene glycol monobutyl ether. It is sufficient to use the glycol ether in an amount of about 5 to about 30% by volume. An excessive amount may decrease its effect on some dyes. It was also found that, if necessary, the glycol ether can be added to the transfer solution used in transferring the colored image to another substrate material to produce a transferred dye image of satisfactory quality.

The glycol ethers in the dye solution can exhibit more desirable effect when used in combination with a fluorinated surface active agent. Such a surface active agent may also be added to a transfer solution.

The fluorinated surface active agents useful according to this invention include those described in Japanese Patent Publication Nos. 9,303/72 and 43,130/73; Japanese Patent Application "Kokai" (Laid-open) Nos. 7,781/71, 46,733/74, 133,023/74, 99,529/75, 113,221/75, 129,229/76, and 111,330/79; U.S. Pat. No. 3,589,906; and Belg. U.S. Pat. No. 742,680. Other fluorinated surface active agents may also be used. In general, a preferable fluorinated surface active agent contains in a molecule a group having at least 3 fluorine atoms and at least 3 carbon atoms bonded to fluorine atom and a group capable of exhibiting a suitable hydrophilicity such as, for example, carboxylic acid, sulfonic acid, sulfuric acid, phosphoric acid, or salts thereof, hydroxyl group, oxyalkylene group, onium group, and diester group.

As nonlimitative examples of fluorinated surface active agents, mention may be made of the following:

$$CF_3(CF_2)_6-COONH_4 \quad (1)$$

$$CF_3(CF_2)_7-SO_2-\underset{\underset{C_2H_5}{|}}{N}-CH_2-COONa \quad (2)$$

$$CF_3(CF_2)_3-CH_2CH_2-SO_2-\underset{\underset{C_2H_5}{|}}{N}-CH_2-COONa \quad (3)$$

$$CF_3(CF_2)_7-SO_2-\underset{\underset{C_3H_7}{|}}{N}-CH_2-COOK \quad (4)$$

$$CF_3(CF_2)_7-SO_2-\underset{\underset{C_2H_5}{|}}{N}-CH_2-SO_3H \quad (5)$$

$$CF_3(CF_2)_7-SO_3K \quad (6)$$

$$CF_3(CF_2)_{11}-CH_2-OSO_3Na \quad (7)$$

$$CF_3(CF_2)_6-CONH(CH_2)_3-\overset{\oplus}{N}(CH_3)_2-CH_2CH_2-COO^{\ominus} \quad (8)$$

$$CF_3(CF_2)_7-SO_2NHCH_2CH_2\overset{\oplus}{N}(CH_2CH_3)_2-CH_2-COO^{\ominus} \quad (9)$$

$$CF_3(CF_2)_6CON(CH_2CH_2)_2\overset{\oplus}{N}(C_2H_5)(CH_2COO^{\ominus}) \quad (10)$$

$$CF_3(CF_2)_6CON(CH_2CH_2)_2\overset{\oplus}{N}(CH_2CH_2OH)(CH_2CH_2COO^{\ominus}) \quad (11)$$

$$CF_3(CF_2)_8CON(CH_2CH_2)_2\overset{\oplus}{N}(CH_2CH_2OH)(CH_2CH_2COO^{\ominus}) \quad (12)$$

$$CF_3(CF_2)_6CON(C_3H_6SO_3)-C_3H_6\overset{\oplus}{N}(CH_3)_2(CH_2CH_2O)_7H \quad (13)$$

$$\begin{array}{l} CH-COOCH_2(CF_2CF_2)_3H \\ | \\ CH-COOCH_2(CF_2CF_2)_3H \end{array} \quad (14)$$

$$H(CF_2CF_2)_3CH_2OH \quad (15)$$

$$CF_3(CF_2)_6-CO-\underset{\underset{CH_3}{|}}{N}-(CH_2)_2O-(CH_2CH_2)_4H \quad (16)$$

-continued (17)

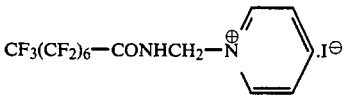

The amount to be used of the fluorinated surface active agent is in the range of about 0.001 to about 5, preferably about 0.01 to about 1%, by weight based on dye solution.

The coloring solution (dye solution) of this invention gives best results when it is an aqueous acidic solution of pH about 6 or less, preferably pH about 5 or less. The acids used in adjusting the pH include organic and inorganic acids such as, for example, acetic acid, citric acid, phosphoric acids, adipic acid, succinic acid, and sulfuric acid. Especially useful dyes in aqueous acidic solution capable of producing a colored image of high density are C.I. Acid Yellow 141, C.I. Acid Red 274, C.I. Reactive Blue 21, C.I. Acid Black 52, C.I. Acid Red 249, C.I. Acid Green 28, C.I. Acid Blue 338, and C.I. Acid Orange 95.

Although the photographic image layer can be dyed before the development, it is preferable to dye after the formation of silver image or after the etching-bleach treatment. The etching bleach is carried out in a well known manner by using, for example, the following processing solution:

Etching-bleach solution:
Solution A (500 ml)
Cupric chloride: 2.5 g
Citric acid: 2.5 g
Solution B
3% aqueous hydrogen peroxide solution 500 ml Solutions A and B are mixed to form 1 liter of the etching-bleach solution.

Ferric chloride can be used in place of the cupric chloride. If necessary, the photographic material can be washed with water before or after the etching-bleach treatment. If the photographic material is not washed with water after the etching-bleach treatment or the photographic material is dyed before the etching-bleach, some dyes bring about discoloration or cloudiness of the material. From this fact, it seems that there occurs some reaction between the dye and the cupric or ferric ion in the coloring solution. It is, therefore, desirable to allow the dye image to be in contact with a chelating agent capable of forming a more stable reaction product with a metal ion than with a dye.

As metal-chelating agents used according to this invention, there may be mentioned the following compounds:

(1) Ethylenediaminetetraacetic acid.
(2) Diethylenetriaminepentaacetic acid.
(3) Triethylenetetraminehexaacetic acid.
(4) Hydroxyethylethylenediaminetriacetic acid.
(5) Nitrilotriacetic acid.
(6) 1,2-Diaminocyclohexanetetraacetic acid.
(7) 1,3-Diamino-2-propanoltetraacetic acid.
(8) Dipicolinic acid.
(9) Bishydroxyphenylethylenediaminediacetic acid.
(10) Pyrophosphates.
(11) Tripolyphosphates.
(12) Trimetaphosphates.
(13) Hexametaphosphates.

The metal-chelating agent is applied to at least one of the photographic material to be etching-bleached (i.e. photographic material to be dyed), etching-bleach solution, dye solution, washing water, dye transfer solution, and substrate material to receive the transferred dye image so that the final dye image may be in contact with the chelating agent. It is possible to treat the dye image with a solution of chelating agent at a desirable stage. The amount used of the chelating agent is not restricted but is generally in a range of about 0.1 to about 30 g/liter in the case of processing solution and about 3 to about 100 mg/m$^2$ in the case of photographic material. The photographic layers, upon which the silver image is formed, include the silver halide emulsion layer and the image receptive layer containing physical development nuclei (e.g. heavy metals or sulfides thereof). The hydrophilic binders used in these layers are preferably proteinaceous substances such as gelatin and related substances which can be partially substituted by other photographic binders including colloid albumin, casein, cellulose derivatives such as carboxymethylcellulose and hydroxyethylcellulose; polysaccharide derivatives such as agar, sodium alginate, and starch derivatives; synthetic hydrophilic colloids such as, for example, polyvinyl alcohol, poly-N-vinylpyrrolidone, polyacrylic acid copolymers, and polyacrylamide. The thickness of such a layer is 0.5 to 10, preferably 0.5 to 5, $\mu$ though other thicknesses are not excluded.

The structural elements of the image receptive material and/or the silver halide photographic material may contain various additives including hardeners such as formaldehyde, mucochloric acid, chrome alum, vinylsulfone compounds, epoxy compounds, and ethyleneimine compounds; antifoggants or stabilizers such as mercapto compounds and tetraazaindene; surface active agents such as saponin, anionic compounds (e.g. sodium alkylbenzenesulfonates, sulfosuccinic acid esters, and alkylarylsulfonates described in U.S. Pat. No. 2,600,831), amphoteric compounds described in U.S. Pat. No. 3,133,816; fluorescent whiteners described in Japanese Patent Publication No. 7,127/59; wetting agents such as waxes, glycerides of higher fatty acids, and higher alcohol esters; mordants such as N-guanylhydrazone compounds, quaternary onium compounds, and tertiary amine compounds; antistatics such as diacethylcellulose, styreneperfluoroalkylene sodium maleate copolymers, and alkali salts of the reaction product of styrene-maleic anhydride copolymers and p-aminobenzenesulfonic acid; film property improving agents such as polymethacrylates, polystyrene, acrylic esters, and various latices; plasticizers for gelatin such as glycerol and substances described in Japanese Patent Publication No. 4,939/68; pigments such as titanium dioxide; thickeners such as styrene-maleic acid copolymers and substances described in Japanese Patent Publication No. 21,574/61; antioxidants and pH regulators.

The support can be any of the film supports such as polyethylene terephthalate, polystyrene, polypropylene, and polycarbonate; baryta paper, and polyolefin-coated paper supports.

An example of useful photographic material is composed of a transparent film support and, provided thereon, a silver image forming layer, e.g. an image receptive layer, containing a white pigment, e.g. titanium dioxide, and overlaid with a protective layer of a hydrophilic binder. Because of the hiding power of white pigment, such a material is useful in utilizing the colored image as an overlay. The white pigment containing layer is difficult to produce a colored image of sufficient density when processed with a coloring solution. Such a difficulty was found to overcome by providing a protective layer. From the viewpoint of etching-bleach, the coverage of the protective layer of hydrophilic binder is preferably about 0.5 to about 1.5 g/m$^2$. The coverage of white pigment is preferably in the range of from about 3 to about 10 g/m$^2$.

A method of transferring the colored dye image to another substrate material is described below.

According to this invention there is provided a method of transferring the colored dye image obtained as described above to another substrate material by establishing close contact through a medium of an acidic liquid. In one of the preferred embodiments, the acidic liquid, which serves as a medium for the transfer, contains a gelatin hardener. The staining caused by the dye, as described previously, can be avoided by hardening the colored image forming layer and the transferred image receiving layer. However, the colored image forming layer should not be too much hardened, because the layer must be etching-bleachable. Moreover, hardening of the colored image forming layer retards, or even hinders, the transfer of colored image. Therefore, the hardener content of the acidic liquid should be carefully selected so that the dye transfer may not be too much hindered. An acidic liquid as the transfer medium was found to be far more effective than a hardener in alleviating the staining caused by the dye. Although the reason for this is yet to be elucidated, it seems that under acidic conditions the amino group of gelatin in the colored image layer dissociates to an increased degree and reacts with the dye to suppress the elution and diffusion of the dye until the beginning of dye transfer initiated by the establishment of close contact between the colored image and the substrate material; the dye transferred to the substrate material is detained there likewise. In this sense, hardeners which block the functional group of gelatin detract from the advantage of etching-bleachable gelatin, but contribute to the physical suppression of the diffusion of dyes. Therefore, hardeners should be used not in a large amount but in an auxiliary amount.

The acidic liquid used in the transfer of dye images is an aqueous solution having a pH value of generally about 6 or less, preferably about 5 or less, most preferably 4.5 or less. The acids used in acidifying the solution are those used in the coloring solution (dye solution). The acidic liquid, which serves as the transfer medium for dyes can be the coloring solution itself when the colored image is directly, without drying, brought into close contact with the substrate material. When, if necessary, the colored image is washed with water and dried, the acidic solution is preferably a solution (referred to as transfer solution) other than the dye solution which is also preferably acidic. It is, of course, possible to recolor with a dye solution.

The transfer solution is fed preferably to either one of the photographic material carrying the colored image and the substrate material, though can be fed to both materials. The feeding of the acidic liquid is performed by coating with a writing brush or painting brush or by dipping. The hardeners suitable for use in the acidic transfer solution are alum, formaldehyde, mucochloric acid, and glutaraldehyde. Coagulants for gelatin such as sodium sulfate can also be used.

The transfer solution contains preferably a glycol ether as described above. The dye in the colored image is transferred not totally but partially. The fraction of transferred dye is small when a glycol ether is absent in the transfer solution. It was confirmed that the presence of a glycol ether accelerates the rate of transfer, diminishes the staining caused by the dye, and enhances the depth of color in the transferred image. The presence of a glycol ether makes it possible to retransfer the transferred image to another substrate material and to transfer the remaining colored image, which is left behind after the first transfer, again to another substrate material. The glycol ether content of the acidic transfer solution is preferably about 3 to about 30% by volume, though not exclusively. The transfer is performed by bringing the colored image and the substrate material into close contact and pressing together by means of a pair of rolls. Heating of the transferred image at 40° to 100° C. is effective for producing a desirable image. The aforementioned binders are preferably used in the image receptive layer of the substrate material. The image receptive layer can contain a hardener and a dyeing mordant.

EXAMPLE 1

A sheet of polyethylene terephthalate film, 100μ in thickness, was coated with 200 mg/m$^2$ (on dry basis) of a subbing solution comprising gelatin (1 part), water (2 parts), glacial acetic acid (3 parts), nitrocellulose (1 part), p-chlorophenol (5 parts), methyl alcohol (27.8 parts), acetone (50 parts), butyl acetate (10 parts), and a very small amount of a matting agent (all parts are by weight). An image receptive material was prepared by providing over the resulting subbing layer a hardened physical development nuclei layer comprising gelatin (1 g/m$^2$) and a reaction product (0.5 g/m$^2$) obtained by heating a mixture of ethylene-maleic anhydride copolymer and polyvinyl alcohol.

A negative material was prepared by providing on a polyethylene-laminated paper support an undercoat of gelatin containing carbon black and overcoating the undercoat with an orthochromatic gelatin emulsion (1.5 g/m$^2$ in terms of silver nitrate) containing silver chlorobromide (5 mole-% silver bromide) of 0.25μ in average grain size, and drying. After image wise exposure, the negative material was brought into close contact with the above image receptive material in a developer of the following composition and processed in a customary manner.

Sodium hexametaphosphate: 0.5 g
Hydroquinone: 12 g
1-Phenyl-3-pyrazolidone: 1 g
Sodium sulfite, anhydrous: 60 g
Sodium thiosulfate: 14 g
Sodium hydroxide: 12 g
Potassium bromide: 1.5 g
Made up with water to: 1 liter The image receptive material was washed with water for 30 seconds and dried [The washing with water can be replaced by the neutralization with an acidic solution (e.g. an aqueous sodium dihydrogen phosphate solution)]. The image receptive material was then dipped into a coloring solution of the following composition for 15 seconds at 20° C., then washed with water and dried.

| Coloring solution | A | A-1 | B | B-1 |
|---|---|---|---|---|
| Dye[a] | 6 | 6 | 15 | 15 g |
| Water | 200 | " | " | 15 ml |
| Glycol ether[b] | — | 30 | — | 30 ml |
| Acetic acid, 90% | 10 | " | " | 30 ml |

-continued

| Coloring solution | A | A-1 | B | B-1 |
|---|---|---|---|---|
| 3N sodium hydroxide solution | 10 | " | " | 30 ml |
| Surface active agent[c] | 0.1 | " | " | 30 g |
| Made up with water to 300 ml | | | | |

Note:
[a]C.I. Reactive Blue 21.
[b]3-Methyl-3-methoxybutanol.
[c]Exemplified compound No. 12

The image receptive material was then immersed in the aforementioned etching-bleach solution at 20° C. for 60 seconds to remove the image receptive layer in the silver image carrying areas, then washed with water, and dried. The transmission density was found to be as shown in Table 1.

TABLE 1

| Coloring solution | A | A-1 | B | B-1 |
|---|---|---|---|---|
| Transmission density | 1.24 | 1.73 | 1.39 | 2.42 |

EXAMPLE 2

The procedure of Example 1 was repeated, except that coloring solutions A-2 and B-2 were prepared by using ethylene glycol monobutyl ether in place of the 3-methyl-3-methoxybutanol.

TABLE 2

| Coloring solution | A | A-2 | B | B-2 |
|---|---|---|---|---|
| Transmission density | 1.24 | 1.82 | 1.39 | 2.58 |

EXAMPLE 3

The procedure of Example 1 was repeated, except that the following coloring solutions were used.

| Coloring solution | C | C-1 | D | D-1 |
|---|---|---|---|---|
| Dye[a-1] | 3 | 3 | 15 | 15 |
| Water | 200 | " | " | " |
| Glycol ether[b-1] | — | 45 | — | 45 |
| Acetic acid, 90% | 10 | " | " | " |
| 3N sodium hydroxide solution | 10 | " | " | " |
| Surface active agent[c-1] | 0.1 | " | " | " |
| Made up with water to | | 300 ml | | |

Note:
[a-1]C.I. Acid Black 52
[b-1]Diethylene glycol diethyl ether
[c-1]Exemplified compound No. 12

The results obtained were as shown in Table 3.

TABLE 3

| Coloring solution | C | C-1 | D | D-1 |
|---|---|---|---|---|
| Transmission density | 1.04 | 1.65 | 1.30 | 2.29 |

EXAMPLE 4

The procedure of Example 1 was followed, except that the following coloring solutions were used.

| Coloring solution | E | E-1 | F | F-1 |
|---|---|---|---|---|
| Dye[a-2] | 6 | 6 | 15 | 15 |
| Water | 200 | " | " | " |
| Glycol ether[b-2] | — | 30 | — | 30 |
| Acetic acid, 90% | 10 | " | " | " |
| 3N sodium hydroxide solution | 10 | " | " | " |
| Surface active agent[b-3] | 0.1 | " | " | " |
| Made up with water to | | 300 ml | | |

Note:
[a-2]C.I. Acid Red 274
[b-2]Propylene glycol monomethyl ether
[b-3]Exemplified compound No. 14

The results obtained were as shown in Table 4.

TABLE 4

| Coloring solution | E | E-1 | F | F-1 |
|---|---|---|---|---|
| Transmission density | 1.58 | 2.37 | 1.78 | 3.45 |

EXAMPLE 5

Coloring solutions E-2 and F-2 were prepared in the same manner as in Example 4, except that ethylene glycol monoethyl ether was used in place of the glycol ether (b-2). The results obtained were as shown in Table 5.

TABLE 5

| Coloring solution | E | E-2 | F | F-2 |
|---|---|---|---|---|
| Transmission density | 1.58 | 2.53 | 1.78 | 3.67 |

EXAMPLE 6

The procedure of Example 1 was repeated, except that a polyethylene-coated paper was used as the support of image receptive material. The results obtained were similar to those in Example 1.

EXAMPLE 7

The same image receptive material as used in Example 1 was subjected to etching-bleach treatment, dried, then colored with a coloring solution used in Example 1, 3, or 4 by means of a writing brush, then washed with water and dried. The results obtained were similar to those obtained in Example 1.

EXAMPLE 8

The procedure of Example 1 was repeated, except that the dye used in the coloring solution was C.I. Acid Red 249, C.I. Acid Green 28, C.I. Acid Blue 338, or C.I. Acid Orange 95. All of the dyes gave the results similar to those obtained in Example 1.

EXAMPLE 9

An image receptive material was prepared by providing on a subbed polyester film support a physical development nuclei layer comprising 2 g/m$^2$ of gelatin. A commercial photosensitive material (One Step NE ® of Mitsubishi Paper Mills) for use in the silver complex diffusion transfer process was imagewise exposed. The exposed material and the above image receptive material were placed one upon the other and processed with the developer for exclusive use. The image receptive material was washed briefly with water and dried. The material was then dipped in a coloring solution of the following composition at 20° C. for 15 seconds, then washed with water, and dried.

[Coloring solution]

C.I. Acid Yellow 141: 10 g
Water: 200 ml
3-Methyl-3-methoxybutanol: 30 ml

Acetic acid, 90%: 10 ml
3N sodium hydroxide solution: 10 ml
Surface active agent [exemplified compound (2)]: 0.1 g
Made up with water to: 300 ml There was obtained the image receptive material dyed in bright yellow color, 2.4 in transmission density. The material was then dipped in the aforesaid etching-bleach solution at 20° C. for 60 seconds to remove the image receptive layer in silver image areas. The material was washed with water and dried. The resulting image was in hazy yellow color resulted from the initial bright yellow through bathochromic shift. This image receptive material carrying the image in hazy yellow was immersed in an aqueous solution containing 3 g/liter of disodium salt of ethylenediaminetetraacetic acid for 60 seconds and dried. The initial image colored in bright yellow was restored.

EXAMPLE 10

Three types of coating solutions of the following compositions having different gelatin content were prepared.

| | |
|---|---|
| Solution A | |
| Gelatin | 10, 14, or 20 g |
| Water | 150 ml |
| Colloidal nickel sulfide solution (5 mM/liter) | 40 ml |
| 1-Phenyl-5-mercaptotetrazole (1% methanol solution) | 10 ml |
| 2,4-Dichloro-6-hydroxy-S—triazine disodium salt (5% aqueous solution) | 4 ml |
| Sodium dodecylbenzenesulfonate (5% aqueous solution) | 10 ml |
| Solution B | |
| Titanium oxide | 60 g |
| Water | 100 g |
| Dispersant | 2 ml |

Solutions A and B were mixed and made up with water to 400 g.

The coating solution was coated on a subbed polyethylene terephthalate film base at a gelatin coverage of 1.0, 1.4, or 2.0 g/m$^2$, on dry basis, to form an image receptive layer which wash then dried. The titanium dioxide content of each layer was 6 g/m$^2$.

A coating solution of the following composition was prepared to form an overcoat layer.

| | |
|---|---|
| Lime-treated gelatin | 5 g |
| Water | 90 ml |
| 2,4-Dichloro-6-hydroxy-S—triazine sodium salt (5% aqueous solution) | 90 ml |
| Sodium dodecylbenzenesulfonate (5% aqueous solution) | 2.5 ml |
| Total | 100 g |

The coating solution was applied over the image receptive layer at a rate of 0.6 or 1.0 g/m$^2$, on dry basis, so that the total amount of gelatin including the gelatin in the image receptive layer may become 2.0 g/m$^2$. After drying the resulting image receptive material was conditioned for 24 hours at 70% RH and heated at 40° C. for 7 days.

A photosensitive material was prepared by providing on a polyethylene-laminated paper support an undercoat layer containing antihalation carbon black, and providing thereon a gelatino silver halide emulsion layer comprising 1.5 g/m$^2$ (in terms of silver nitrate) of orthochromatic silver chlorobromide (5 mole-% silver bromide) of 0.3$\mu$ in average grain size, 0.2 g/m$^2$ of 1-phenyl-3-pyrazolidone, 0.7 g/m$^2$ of hydroquinone, and 4 g/m$^2$ of gelatin. The silver halide emulsion layer was hardened by a hardener present in the emulsion layer to avoid difficulties which might be encountered in the diffusion transfer treatment.

A diffusion transfer processing solution of the following composition was used.

Water: 800 ml
Sodium hydroxide: 25 g
Sodium sulfite, anhydrous: 100 g
Hydroquinone: 20 g
1-Phenyl-3-pyrazolidone: 1 g
Potassium bromide: 3 g
Sodium thiosulfate: 30 g
1-Phenyl-5-mercaptotetrazole: 0.1 g
Made up with water to: 1000 ml The photosensitive material thus obtained was correctly exposed, in a process camera, to an original bearing suitable black areas. The exposed photosensitive material and the image receptive material were arranged so as to bring the emulsion surface into close contact with the image receptive surface, and passed through a processor containing the diffusion transfer processing solution and provided with squeeze rolls. Thirty seconds after emergence from the processor, both materials were pulled apart. The image receptive material was washed with water for about 30 seconds, then subjected to etching-bleach treatment by immersing in the aforementioned etching-bleach solution at 20° C. for 60 seconds to remove the image receptive layer in the silver image areas. After washing with water and drying, there was formed a white opaque image on the surface of image receptive material. The coloring was performed by dipping at 20° C. for 30 seconds in the coloring solution (B-1) of Example 1 containing one of the following dyes in place of the dye used in Example 1. The residual coloring solution in the image receptive material was removed by washing with water.

(a) C.I. Acid Yellow 141
(b) C.I. Acid Red 274
(c) C.I. Reactive Blue 21

After drying, the color density was measured. The results obtained were as shown in Table 6.

TABLE 6

| | (a) | (b) | (c) |
|---|---|---|---|
| Gelatin in overcoat | Lime-treated gelatin | | |
| Type | | | |
| Coating rate (g/m$^2$ dry basis) | 0 | 0.6 | 1.0 |
| Gelatin in image receptive layer Coating rate (g/m$^2$ dry basis) | 2.0 | 1.4 | 1.0 |
| Color density | | | |
| Yellow | 0.93 | 1.35 | 2.09 |
| Magenta | 1.04 | 1.62 | 2.38 |
| Cyan | 0.93 | 1.52 | 2.29 |
| Susceptibility to etching-bleach* | o | o | ◎ |

Note:
*Susceptibility to etching-bleach:
o Very good
◎ Good
x Poor

As is apparent from the results shown in Table 1, samples (b) and (c) showed good absorption of dyes and sufficient color density. The susceptibility to etching-bleach showed decreasing tendency with the increase in thickness of the overcoating layer, but the tendency is not marked within the practical range of thickness.

EXAMPLE 11

A silver image was formed on the image receptive material by following the procedure of Example 9. The material was then immersed in the coloring solution (B-1) of Example 1 at 20° C. for 30 seconds, then washed with water, dried, then immersed in the aforesaid etching-bleach solution at 20° C. for 60 seconds to remove the image receptive layer in the areas bearing the silver image, then washed with water, and dried. The colored image thus formed showed a transmission density of 2.8. An aqueous acetic acid solution (transfer solution, pH 3.5) containing 10% by volume of propylene glycol monobutyl ether was fed, by means of a sponge, all over the image receptive surface. The image receptive surface thus treated was brought into close contact with the image receptive surface of another image receptive material (substrate material) by means of rolls, and heated at 80° C. for 30 seconds. Upon being pulled apart, the substrate material was found to carry a transferred dye image of a transmission density of 1.6 and completely free from stains.

EXAMPLE 12

The procedure of Example 11 was repeated, except that the support of the substrate material was a polyethylene-coated paper sheet. The results obtained were similar to those obtained in Example 11.

EXAMPLE 13

The substrate material obtained in Example 11 was dipped in the same transfer solution as used in Example 11 and the image was transferred to the same substrate material as used in Example 12. There was obtained a transferred positive dye image which was sharp and entirely free from dye stains.

EXAMPLE 14

The substrate material obtained in Example 11 was dipped in the same transfer solution as used in Example 11 and brought into contact with a colored image receptive material. There was obtained a desirable transferred dye image as in Example 11.

EXAMPLE 15

The procedure of Example 11 was repeated, except that use was made of a transfer solution containing 3 g/liter of alum and adjusted to pH 3.5, 4.5, or 5.5 with citric acid. The results were satisfactory, being similar to those obtained in Example 11.

EXAMPLE 16

A silver halide photosensitive material was prepared in the same manner as in Example 11, except that the undercoat layer of the negative material was not provided. After imagewise exposure, the material was developed in D-72 developer and fixed. In the same manner as in Example 11, the resulting material was colored and subjected to the etching-bleach treatment. Using as transfer solution an aqueous citric acid solution (pH 4.0) containing 10% by volume of propylene glycol monomethyl ether, the image was transferred, as in Example 12, to the same image receptive material (substrate material) as used in Example 12. There was obtained a transferred dye image which was sharp and entirely free from dye stains.

EXAMPLE 17

The colored material used in Example 16 was coated again, by means of a brush, with the transfer solution and the image was transferred to another substrate material in a manner similar to that in Example 16. There was obtained a transferred dye image which was substantially the same in quality as that in Example 16. Such transfer can be repeated several times. Furthermore, a good many transferred dye images were obtained by repeating the procedure of coloring the said colored material and transferring.

What is claimed is:

1. A process for forming a colored photographic image, wherein a photographic material bearing a silver image present in a hydrophilic protein binder is subjected to an etching-bleach treatment and the unbleached areas are colored with a coloring solution to form a colored image, which comprises before or/and after said etching-bleach treatment coloring said photographic material with an aqueous coloring solution containing at least a water-soluble dye and a glycol ether and having a pH of about 6 or less.

2. A process according to claim 1 wherein the hydrophilic protein binder is a gelatin binder.

3. A process according to claim 1, wherein the glycol ether content of the coloring solution is in the range of from about 5 to about 30% by volume.

4. A process according to claim 1, wherein the water-soluble dye in the coloring solution is selected from acid dyes.

5. A process according to claim 1, wherein the concentration of the water-soluble dye in the coloring solution is in the range of from about 1 to about 10% by weight.

6. A process according to claim 1, wherein the coloring solution contains a fluorinated surface active agent in addition to the water-soluble dye and the glycol ether.

7. A process according to claim 6, wherein the fluorinated surface active agent content of the coloring solution is in the range of from about 0.001 to about 5% by weight based on the coloring solution.

8. A process according to claim 1, wherein the water-soluble dye is selected from C.I. Acid Yellow 141, C.I. Acid Red 274, C.I. Reactive Blue 21, C.I. Acid Black 52, C.I. Acid Red 249, C.I. Acid Green 28, C.I. Acid Blue 338, and C.I. Acid Orange 95 in Color Index General Names.

9. A process according to claim 1, wherein the processing of the photographic material is carried out under the conditions such that a metal chelating agent is disposed in contact with the colored image.

10. A process according to claim 1, wherein the photographic material bearing a silver image is an image receptive material having a physical development nuclei layer which bears a silver image formed by the silver complex diffusion transfer process.

11. A process according to claim 10, wherein the image receptive material comprises a transparent support and a physical development nuclei layer containing a white pigment.

12. A process according to claim 1, which further comprising transfering the colored dye image to another substrate material through a medium of an acidic liquid.

13. A process according to claim 12 wherein the acidic liquid contains a glycol ether.

14. A process according to claim 12 wherein the acidic liquid has a pH of about 5 or less.

15. A process according to claim 12 wherein the acidic liquid has a gelatin hardener.

16. A process according to claim 12 wherein the transferred image is heated to about 40° C.–about 100° C.

* * * * *